US008429822B2

(12) United States Patent
Wolf et al.

(10) Patent No.: US 8,429,822 B2
(45) Date of Patent: Apr. 30, 2013

(54) FABRICATED VEHICLE WHEEL, WHEEL RIM FOR USE IN SUCH A VEHICLE WHEEL AND METHOD FOR PRODUCING SAME

(75) Inventors: Joseph Wolf, Canton, MI (US); Alan Coleman, Southgate, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 887 days.

(21) Appl. No.: 12/431,317

(22) Filed: Apr. 28, 2009

(65) Prior Publication Data

US 2010/0269346 A1 Oct. 28, 2010

(51) Int. Cl.
*B23P 17/00* (2006.01)

(52) U.S. Cl.
USPC ..... 29/894.351; 29/894.322; 29/894.325; 29/894.35

(58) Field of Classification Search ..... 29/894.3, 29/894.32, 894.321, 894.322, 894.323, 894.35, 29/894.351, 894.353, 894.354, 894.325; 72/56, 60, 61; 301/95.101
See application file for complete search history.

(56) References Cited

U.S. PATENT DOCUMENTS

| | | | | |
|---|---|---|---|---|
| 2,185,347 | A * | 1/1940 | Le Jeune | 29/894.354 |
| 2,743,691 | A * | 5/1956 | Cuq | 72/58 |
| 3,347,302 | A | 10/1967 | Lemmerz | |
| 3,907,371 | A * | 9/1975 | Luedi et al. | 301/95.101 |
| 4,127,022 | A | 11/1978 | Bosch | |
| 4,143,533 | A | 3/1979 | Bosch | |
| 4,185,370 | A | 1/1980 | Evans | |
| 4,414,728 | A * | 11/1983 | Ford et al. | 29/894.353 |
| 4,962,587 | A | 10/1990 | Ashley, Jr. et al. | |
| 5,188,429 | A | 2/1993 | Heck et al. | |
| 5,360,261 | A | 11/1994 | Archibald et al. | |
| 5,421,642 | A | 6/1995 | Archibald | |
| 5,533,261 | A | 7/1996 | Kemmerer | |
| 6,189,357 | B1 * | 2/2001 | Baumgarten et al. | 72/70 |
| 6,536,111 | B1 * | 3/2003 | Baumgarten et al. | 29/894.324 |
| 2006/0042091 | A1 * | 3/2006 | Luschei et al. | 29/894.35 |
| 2007/0169346 | A1 * | 7/2007 | Hui | 29/894.35 |
| 2008/0054711 | A1 | 3/2008 | Dal Pra' et al. | |
| 2008/0054712 | A1 | 3/2008 | Urbani | |

* cited by examiner

*Primary Examiner* — David Bryant
*Assistant Examiner* — Ryan J Walters
(74) *Attorney, Agent, or Firm* — MacMillan, Sobanski & Todd, LLC

(57) ABSTRACT

A method for producing a fabricated vehicle wheel comprising the steps of: (a) providing a rim blank; (b) providing a first tooling fixture for subjecting the rim blank to a preforming operation wherein the cylindrical shape is reshaped to produce a rim preform; (c) providing a second tooling fixture defining a sealed internal chamber and having a tooling member having a predetermined inner surface contour, the sealed internal chamber in fluid communication with a source of high pressurize hydraulic fluid; (d) positioning the rim preform in the internal chamber with an outer surface thereof adjacent the inner surface contour of the tooling member; (e) supplying the high pressure hydraulic fluid to the internal chamber whereby the rim preform is pressed against the adjacent inner surface contour of the tooling member so as to produce a wheel rim having a contour which matches that of the inner surface contour of the tooling member; (f) removing the wheel rim from the second tooling fixture; and (g) securing the wheel rim to a wheel disc to produce the fabricated vehicle wheel.

17 Claims, 7 Drawing Sheets

FABRICATED VEHICLE WHEEL, WHEEL RIM FOR USE IN SUCH A VEHICLE WHEEL AND METHOD FOR PRODUCING SAME

BACKGROUND OF THE INVENTION

This invention relates in general to fabricated vehicle wheels and in particular to an improved fabricated vehicle wheel, wheel rim for use in such a vehicle wheel, and method for producing the same.

A conventional fabricated bead seat attached vehicle wheel is of a two-piece construction and includes an inner wheel disc and an outer "full" wheel rim. The wheel disc can be cast, forged or fabricated from steel, aluminum, or other alloys, and includes an inner annular wheel mounting portion and an outer annular portion. The wheel mounting portion defines an inboard mounting surface and includes a center pilot or hub hole, and a plurality of lug receiving holes formed therethrough for mounting the wheel to an axle of the vehicle. The wheel rim can be cast, forged or fabricated from steel, aluminum, or other alloys, and includes an inboard tire bead seat retaining flange, an inboard tire bead seat, an axially extending well, an outboard tire bead seat, and an outboard tire bead seat retaining flange. In some instances, a three-piece wheel construction having a mounting cup secured to the wheel disc is used. In both types of constructions, the outer annular portion of the wheel disc is secured to the wheel rim by welding. Typically the wheel disc is secured to the wheel rim in the region of the well of the wheel rim, to thereby produce a well-attached fabricated vehicle wheel or in the region of the outer tire bead seat of the wheel rim, to thereby produce a bead-seat attached fabricated vehicle wheel.

A full face fabricated wheel is distinguished from other types of fabricated wheels by having a one-piece wheel disc construction. In particular, the full face wheel includes a "full face" disc and a "partial" rim. The full face disc can be formed cast, forged, or fabricated from steel, aluminum, or other alloys. The full face disc includes an inner annular wheel mounting portion and an outer annular portion which defines at least a portion of an outboard tire bead seat retaining flange of the wheel. The wheel mounting portion defines an inboard mounting surface and includes a center pilot or hub hole, and a plurality of lug receiving holes formed therethrough for mounting the wheel to an axle of the vehicle. The partial rim is fabricated from steel, aluminum, or other alloys, and includes an inboard tire bead seat retaining flange, an inboard tire bead seat, an axially extending well, and an outboard tire bead seat. In some instances, the outboard tire bead seat of the rim and the outer annular portion of the disc cooperate to form the outboard tire bead seat retaining flange of the full face wheel. In both types of constructions, the outboard tire bead seat of the rim is positioned adjacent the outer annular portion of the disc and a weld is applied to secure the rim and the disc together.

A typical sequence of steps which can be used to produce a wheel rim for a fabricated vehicle wheel is disclosed in U.S. Pat. No. 4,185,370 to Evans. As shown in this patent, the method includes the steps of: (a) providing a flat sheet of suitable material, such as aluminum or steel; (b) forming the sheet into a cylindrical hoop or band; (c) flaring the lateral edges of the hoop radially outwardly to produce a rim preform having flanges suitable for positioning on a roll forming machine; (d) subjecting the rim preform to a series of roll forming operations to produce a wheel rim having a predetermined shape; and (e) expanding the wheel rim to a produce a finished wheel rim having a predetermined circumference.

U.S. Pat. No. 4,962,587 to Ashley, Jr. et al. discloses another method for producing a wheel rim. According to the method of this patent, a preformed wheel rim is provided having opposed finished tire bead seat retaining flanges, opposed finished tire bead seat surfaces, a well, and an axially extending inboard leg. Next, the well and adjacent rim end are mounted on a mandrel and end plate, respectively, for rotation therewith. A flow spinning roller is then actuated and advanced to engage the well and inboard leg portion thereby thinning-stretching the well and leg portions of the preformed wheel rim.

Other methods for producing wheel rims by rolling or pressing operations are disclosed in U.S. Pat. No. 3,347,302 to Lemmerz, U.S. Pat. No. 4,127,022 to Bosch, and U.S. Pat. No. 4,143,533 to Bosch.

SUMMARY OF THE INVENTION

This invention relates to an improved fabricated vehicle wheel, wheel rim for use in such a vehicle wheel, and method for producing the same. According to one embodiment, a method for producing a fabricated vehicle wheel comprising the steps of: (a) providing a wheel rim blank formed from a suitable material, the wheel rim blank being in the shape of a generally cylindrical hoop; (b) providing a first tooling fixture for subjecting the wheel rim blank to a preforming operation wherein the cylindrical shape is reshaped to include a plurality of differently shaped portions and produce a wheel rim preform; (c) providing a second tooling fixture defining a sealed internal chamber and having a tooling member having a predetermined inner surface contour, the sealed internal chamber in fluid communication with a source of high pressurize hydraulic fluid; (d) positioning the wheel rim preform in the sealed internal chamber of the second tooling fixture with an outer surface of the wheel rim preform adjacent the predetermined inner surface contour of the tooling member; (e) supplying the high pressure hydraulic fluid to the sealed internal chamber of the second tooling fixture whereby the wheel rim preform is pressed against the adjacent inner surface contour of the tooling member so as to produce a finished wheel rim having a contour which matches that of the predetermined inner surface contour of the tooling member; (f) removing the finished wheel rim from the second tooling fixture; and (g) securing the finished wheel rim to a wheel disc to produce the fabricated vehicle wheel. Also, this invention relates to a fabricated vehicle wheel produced according to the method described immediately above.

In another embodiment of the invention, a method for producing a fabricated wheel rim adapted for use in a fabricated vehicle wheel comprising the steps of: (a) providing a wheel rim blank formed from a suitable material, the wheel rim blank being in the shape of a generally cylindrical hoop; (b) providing a first tooling fixture for subjecting the wheel rim blank to a preforming operation wherein the cylindrical shape is reshaped to include a plurality of differently shaped portions and produce a wheel rim preform; (c) providing a second tooling fixture defining a sealed internal chamber and having a tooling member having a predetermined inner surface contour, the sealed internal chamber in fluid communication with a source of high pressurize hydraulic fluid; (d) positioning the wheel rim preform in the sealed internal chamber of the second tooling fixture with an outer surface of the wheel rim preform adjacent the predetermined inner surface contour of the tooling member; (e) supplying the high pressure hydraulic fluid to the sealed internal chamber of the second tooling fixture whereby the wheel rim preform is pressed against the adjacent inner surface contour of the tooling member so as to produce a finished wheel rim having a contour which matches that of the predetermined inner surface contour of the tooling member; and (f) removing the finished wheel rim from the second tooling fixture for subsequent securing to a wheel disc to produce the fabricated vehicle wheel. Also, this invention relates to a fabricated wheel rim produced according to the method described immediately above.

In yet another embodiment of the invention, a method for producing a fabricated vehicle wheel comprising the steps of: (a) providing a wheel rim blank formed from a suitable material selected formed from the group consisting of steel, aluminum, alloys thereof, magnesium, or titanium, the wheel rim blank being in the shape of a generally cylindrical hoop; (b) providing a first tooling fixture for subjecting the wheel rim blank to a preforming operation wherein the cylindrical shape is reshaped to include a plurality of differently shaped portions and produce a wheel rim preform, the wheel rim preform including at least a pair of opposed angled end portions; (c) providing a second tooling fixture defining a sealed internal chamber and having a tooling member having a predetermined inner surface contour, the sealed internal chamber in fluid communication with a source of high pressurize hydraulic fluid; (d) positioning the wheel rim preform in the sealed internal chamber of the second tooling fixture with an outer surface of the wheel rim preform adjacent the predetermined inner surface contour of the tooling member and with the second tooling fixture capturing the opposed angled end portions of the wheel rim preform; (e) supplying the high pressure hydraulic fluid to the sealed internal chamber of the second tooling fixture whereby the wheel rim preform is pressed against the adjacent inner surface contour of the tooling member so as to produce a wheel rim having a contour which matches that of the predetermined inner surface contour of the tooling member; (f) removing the wheel rim from the second tooling fixture; and (g) securing the wheel rim to a wheel disc to produce the fabricated vehicle wheel. Also, this invention relates to a fabricated vehicle wheel produced according to the method described immediately above.

Other advantages of this invention will become apparent to those skilled in the art from the following detailed description of the preferred embodiments, when read in light of the accompanying drawings.

DESCRIPTION OF THE PREFERRED EMBODIMENTS

Figure 1:
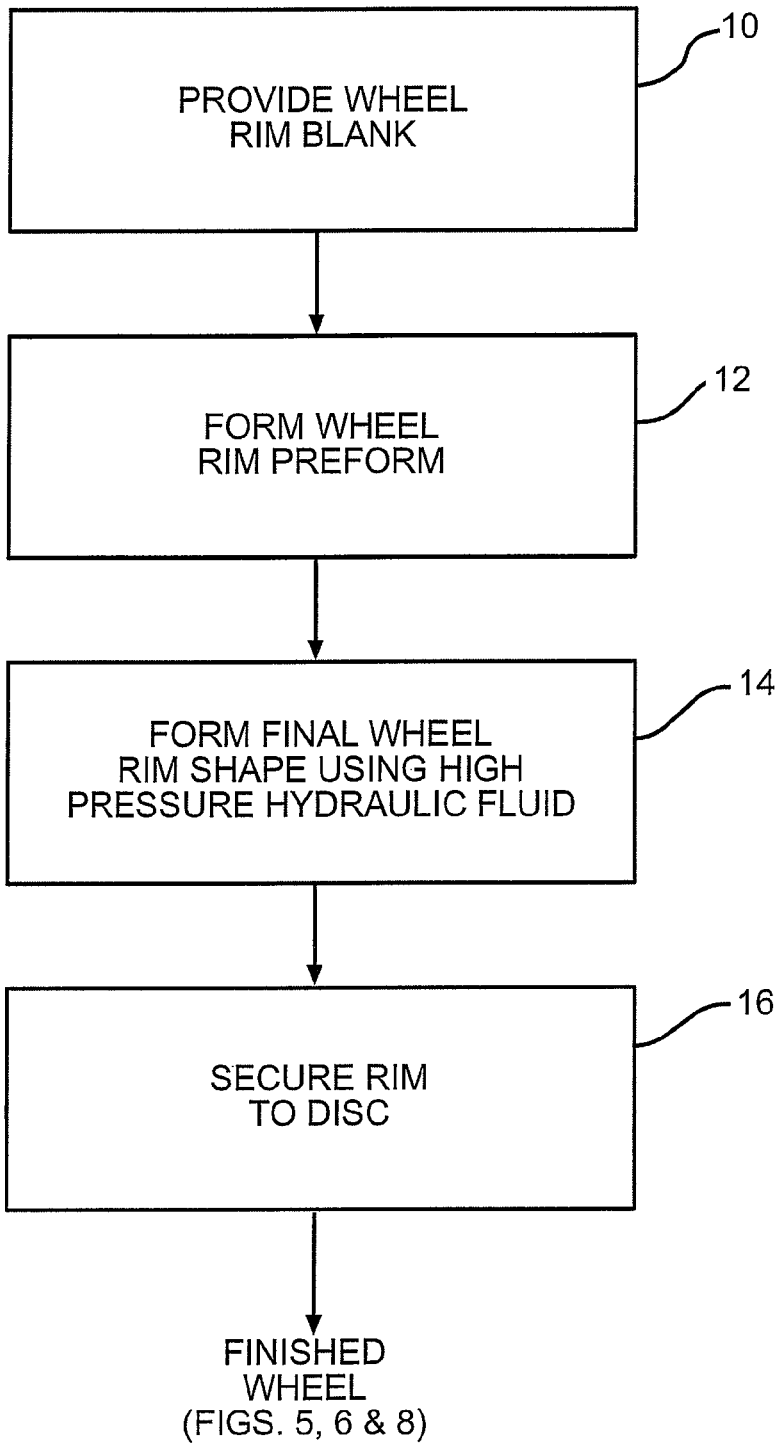
FIG. 1 is a block diagram illustrating a sequence of steps for producing a fabricated vehicle wheel in accordance with the present invention.
Figure 5:
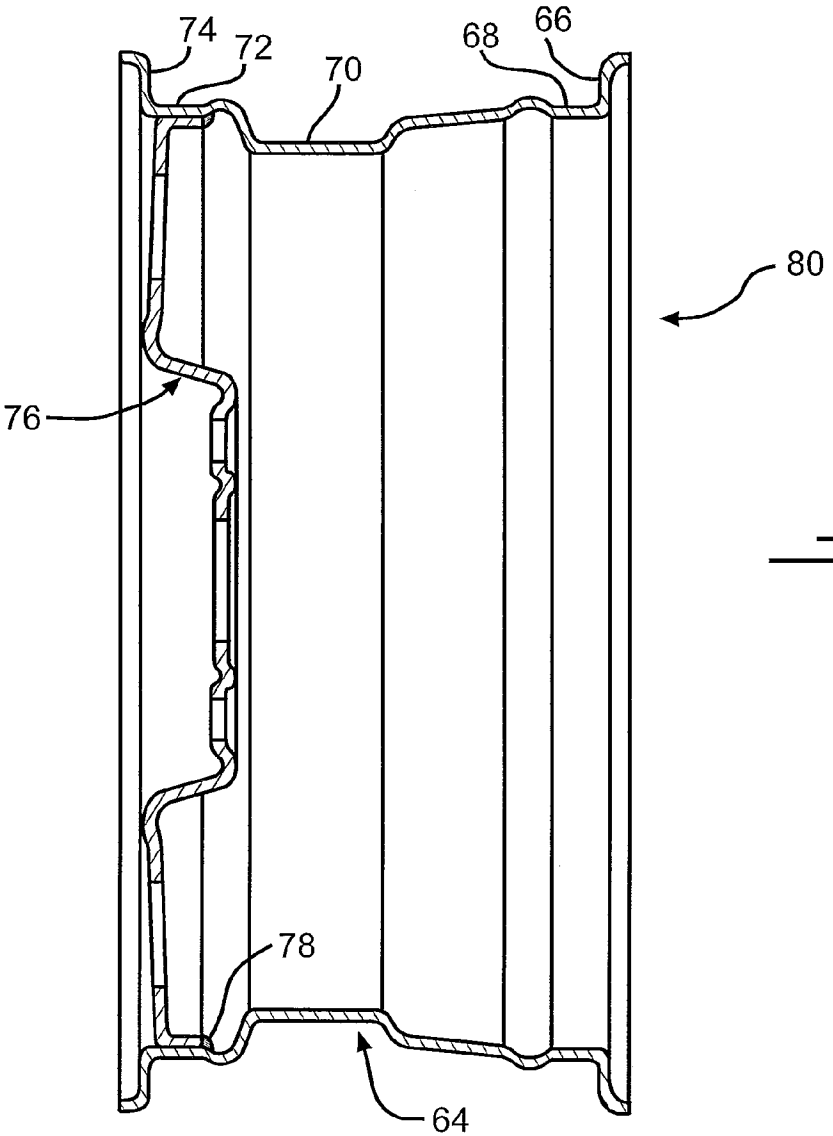
FIG. 5 is a view of the first embodiment of the fabricated vehicle wheel, including the first embodiment of the finished wheel rim of FIG. 4.

Referring now to FIG. 1, there is illustrated a block diagram illustrating a sequence of steps for producing a fabricated vehicle wheel, indicated generally at 80 in FIG. 5, in accordance with the present invention. The fabricated wheel disc 80 of this embodiment is illustrated as being adapted for use in producing a fabricated "bead seat" vehicle wheel. Although the present invention is illustrated and described in conjunction with the particular vehicle wheel constructions disclosed herein, it will be appreciated that the invention can be used in conjunction with other types of fabricated vehicle wheel constructions, if so desired. For example, as shown herein or with modifications thereto, the present invention may be used in connection with other types of fabricated vehicle wheels, such as for example in a "full face" type of vehicle wheel, such as shown in FIG. 5A of U.S. Pat. No. 5,533,261 to Kemmerer, in a "well attached" type of vehicle wheel, such as shown for example in FIG. 3 of U.S. Pat. No. 5,188,429 to Heck et al., a "bimetal" type of vehicle wheel construction including an aluminum disc and a steel rim, such as shown for example in U.S. Pat. No. 5,421,642 to Wei et al., and a "modular wheel" type of construction, such as shown for example in U.S. Pat. No. 5,360,261 to Archibald et al., the disclosures of each of these patents incorporated by reference in their entirety herein.

Figure 2:
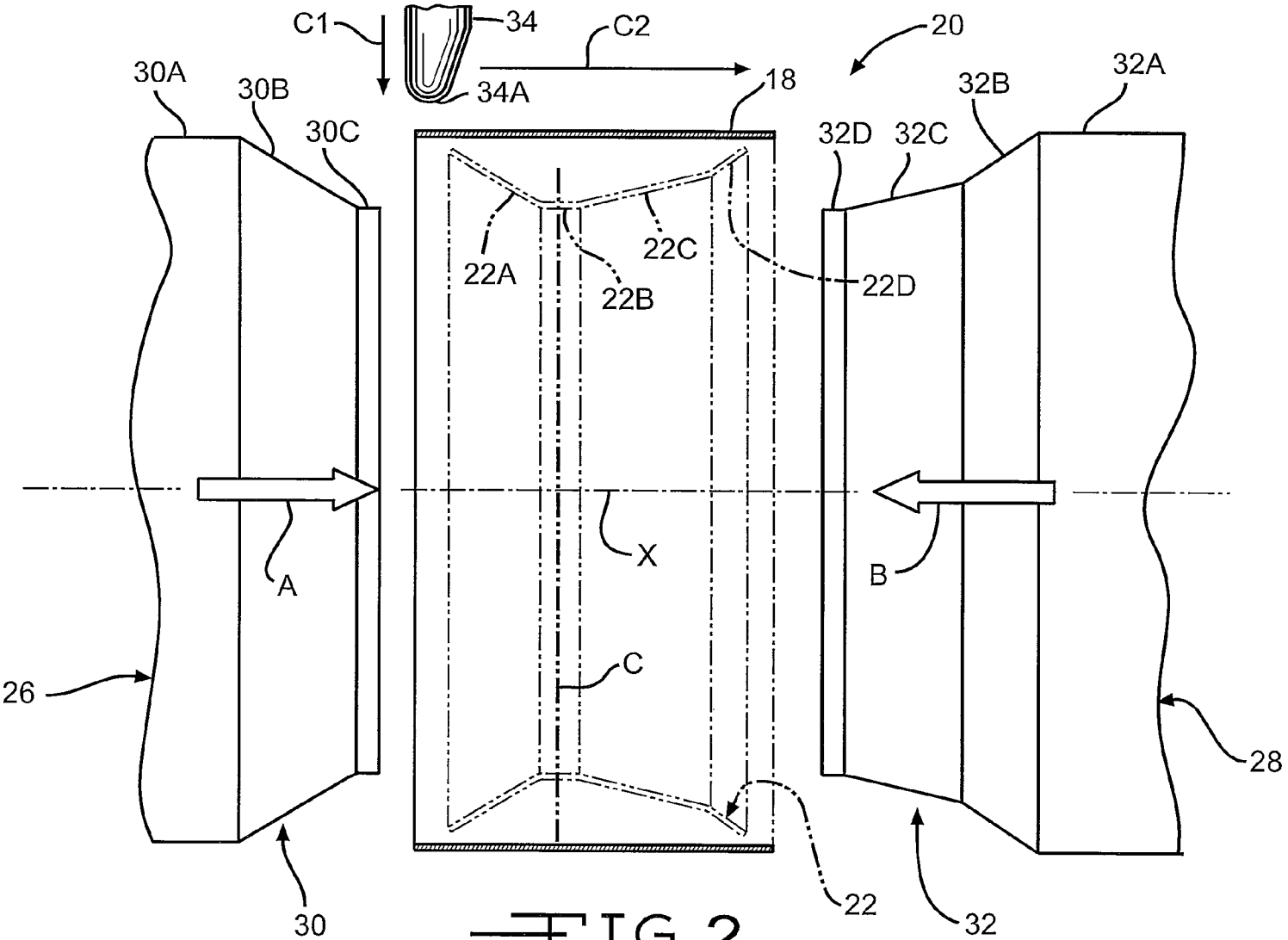
FIG. 2 is a view of a portion of a first tooling for use in producing a first embodiment of a wheel rim, showing the forming of a wheel rim preform according to the method of the present invention.

Initially, as shown in FIG. 1, in step 10, a wheel rim blank, indicated at 18 in FIG. 2 is provided. The wheel rim blank 18 can be formed from any suitable material, such as for example, steel, aluminum, alloys thereof, magnesium, or titanium. Preferably, the wheel rim blank 18 is formed from steel. The wheel rim blank 18 is generally in the shape of a substantially cylindrical hoop.

Next, in step 12, a tooling fixture or apparatus, indicated generally at 20 in FIG. 2 in accordance with this invention, is provided to be used to produce a wheel rim preform, indicated generally at 22 in phantom in FIG. 2, from the wheel rim blank 18. The tooling fixture 20 defines an axis X and includes a first tooling member 26, a second tooling member 28, and a third tooling member 34. The first tooling member 26 can be a one-piece tooling member or can be made up of two or more tooling members. In the illustrated embodiment, the first tooling member 26 is a generally annular one-piece tooling member and includes an outer end, indicated generally at 30, having a predetermined outer surface contour. In the illustrated embodiment, the predetermined outer surface contour of the outer end 30 includes a generally annular first surface 30A, a generally angled or inwardly tapered second surface 30B, and a generally annular third or end surface 30C. Alternatively, the profile and/or construction of the outer end 30 of the first tooling member 26 can be other than illustrated if so desired.

In the illustrated embodiment, the second tooling member 28 is a generally annular one-piece tooling member and includes an outer end, indicated generally at 32, having a predetermined outer surface contour. In the illustrated embodiment, the predetermined outer surface contour of the outer end 32 includes a generally annular first surface 32A, a generally angled or inwardly tapered second surface 32B, and a generally angled or inwardly tapered third surface 32C, and a generally annular fourth or end surface 32D. Alternatively, the profile and/or construction of the outer end 32 of the second tooling member 28 can be other than illustrated if so desired.

In the illustrated embodiment, the third tooling member 34 can be a one-piece tooling member or can be made up of two or more tooling members. In the illustrated embodiment, the third tooling member 34 is a one-piece tooling member and is preferably moveable in the direction of arrows C1 and C2 as it is rotated relative to the first and second tooling members 26 and 28 will be discussed below. As can be seen in FIG. 2, in the illustrated embodiment the third tooling member 34 is a roll spinning roller and is provided with a curved or rounded outer end 34A. Alternatively, the profile and/or construction of the outer end 34A of the third tooling member 34 can be other than illustrated if so desired.

During step 12, the first tooling member 26 is moved in the direction of arrow A and the second tooling member 28 is moved in the direction of arrow B to predetermined positions relative to one another and the wheel rim preform 18. In the illustrated embodiment, the position to which the first tooling member 26 and the second tooling member 28 are moved is noted by line C. In other words, the first tooling member 26 is moved to the right in FIG. 2 and the second tooling member 28 is moved to the left in FIG. 2 until their ends abut one another at the line C.

Next, in step 12, the third tooling member 34 is moved in the direction of arrow C1 so that the outer end 34A thereof engages the wheel rim blank 18. Following this, the third tooling member 34 is moved in the direction of arrow C2 so that the outer end 34A thereof is operative to reshape the wheel rim blank 18 against the associated outer surfaces 30B-30C and 32B-32D of the first and second tooling members 26 and 28, respectively, to produce a wheel rim preform 22 having a desired shape.

As can be seen in FIG. 2, the shape or profile of the wheel rim preform 22 generally corresponds to the shape of the associated outer surfaces 30B-30C and 32B-32D of the first and second tooling members 26 and 28, respectively, which are used. Thus, in the illustrated embodiment, the wheel rim preform 22 includes a generally angled first or outer end portion 22A, a generally annular second portion 22B, a generally angled third portion 22C, and a generally angled fourth or inner end portion 22D. Preferably, the wheel rim preform 22 is formed in one step during step 12; however, depending upon the final shape of the wheel rim preform 22 which is desired and/or the material of the wheel rim blank 18 which is selected, the forming of the wheel rim preform 22 during step 12 can be done in more than one step if so desired. Alternatively, the metal forming process which is used to produce the wheel rim preform 22 and/or the shape thereof formed during step 12 can be other than illustrated if so desired.

Figure 3:
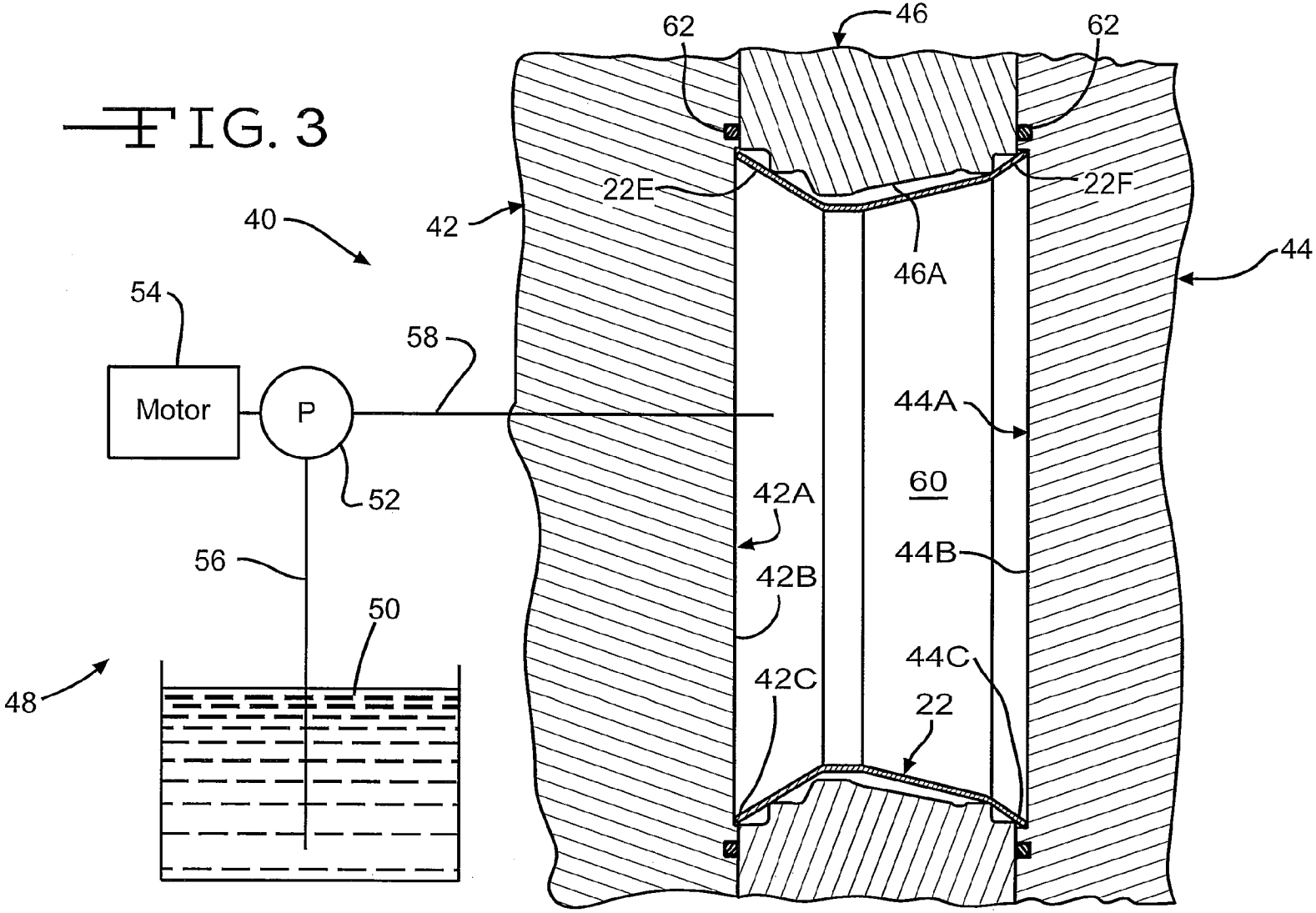
FIG. 3 is a view of a portion of a second tooling for use in producing the first embodiment of a finished wheel rim, showing the initial position of the wheel rim preform before the second tooling is actuated.
Figure 4:
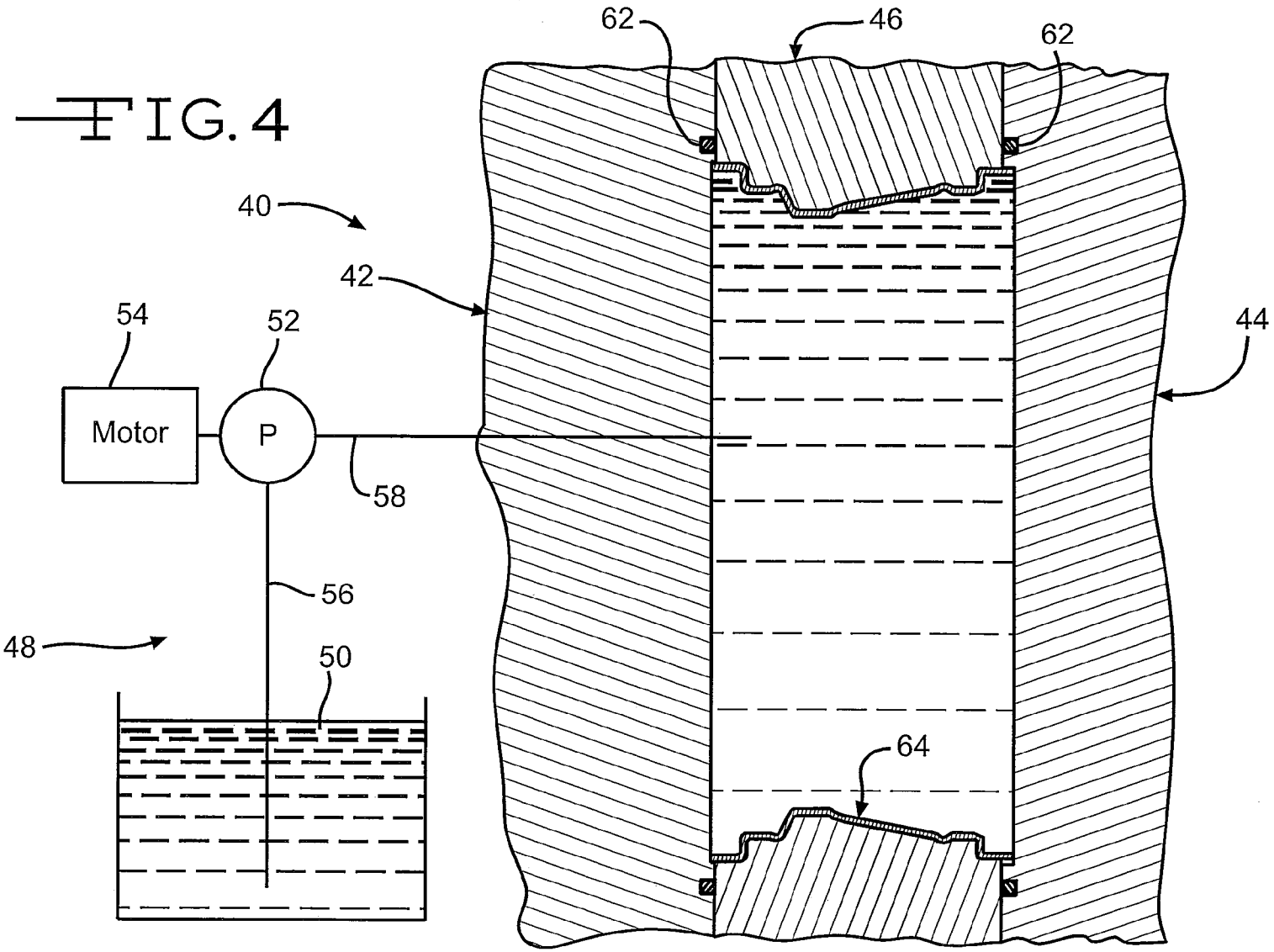
FIG. 4 is another view of the second tooling, showing the actuated state of the second tooling in order to produce the first embodiment of the finished wheel rim.

Next, in step 14, a tooling fixture or apparatus, indicated generally at 40 in FIGS. 3 and 4, is provided to produce a finished wheel rim, indicated generally at 52 in FIG. 4, having a desired final shape from the wheel rim preform 22. As shown therein, the tooling fixture 40 includes a first tooling member 42, a second tooling member 44, a third tooling member 46, and a fourth tooling apparatus 48.

The first tooling member 42 can be a one-piece tooling or "press" member or can be made up of two or more tooling members. In the illustrated embodiment, the first tooling member 42 is a generally annular one-piece tooling member and includes an outer end, indicated generally at 42A, having a annular recess 42B formed therein which defines an annular shoulder 42C therein. Similarly, the second tooling member 44 can be a one-piece tooling or "press" member or can be made up of two or more tooling members. In the illustrated embodiment, the second tooling member 44 is a generally annular one-piece tooling member and includes an outer end, indicated generally at 44A, having an annular recess 44B formed therein which defines an annular shoulder 44C therein. Alternatively, the profile and/or construction of the first tooling member 42 and/or the second tooling member 44 can be other than illustrated if so desired.

In the illustrated embodiment, the third tooling member 46 is a generally annular split or two-piece tooling or "die" member and includes an inner surface, indicated generally at 46A, having a predetermined inner surface contour. As can be readily appreciated, in the illustrated embodiment, the predetermined inner surface contour of the third tooling member 46 preferably generally corresponds to the shape of the finished wheel rim 52.

The fourth tooling apparatus 48 includes a source of hydraulic fluid 50, a pump 52, a motor 54 operatively coupled to the pump 52, a first fluid line 56 connecting the fluid source 50 to the pump 52, and a second fluid line 58 connecting the pump 52 to an interior cavity or sealed chamber 60 of the tooling fixture 40. As shown in the illustrated embodiment, the tooling fixture 40 preferably includes at least a pair of seals 62 to provide the sealed chamber 60.

In step 14, the wheel rim preform 22 is positioned within the tooling fixture 40 and the tooling members 42, 44 and 46 are moved thereagainst to the position as shown in FIG. 3. As shown therein, in this position, opposed ends 22E and 22F of the wheel rim preform 22 are disposed adjacent the shoulders 42C and 44C so as to effectively capture or position the wheel rim preform 22 in the tooling fixture 40. Next, the motor 54 is actuated so that the pump 52 is operative to supply, preferably high pressure hydraulic fluid, into the sealed chamber 60 such that the wheel rim preform 22 is pressed against the adjacent inner surface contour 46A of the third tooling member 46 so that the shape or contour of the finished wheel rim 64 matches that of the inner surface contour 46A of the third tooling member 46A. Preferably, the inner pressure applied to the wheel rim preform 22 during step 14 is about 2000 bar. However, depending upon the material and/or thickness of the wheel rim preform 22 which is used, the inner pressure which is applied during step 14 can be other than described if so desired.

In the illustrated embodiment, the finished wheel rim 64 includes an inboard tire bead seat retaining flange 66, an inboard tire bead seat 68, a well 70, an outboard tire bead seat 72, and an outboard tire bead seat retaining flange 74.

Following this the finished wheel rim 64 is removed from the tooling fixture 40 and is secured to a wheel disc, indicated generally at 76 in FIG. 5 by one or more welds 78, to produce the finished fabricated bead seat attached vehicle wheel 80. Preferably, following step 14, the wheel rim 64 is ready for securing to the wheel disc 76; however, in some instances, slight machining or trimming of the wheel rim 64 may needed prior to assembly to the wheel disc 76.

Figure 6:
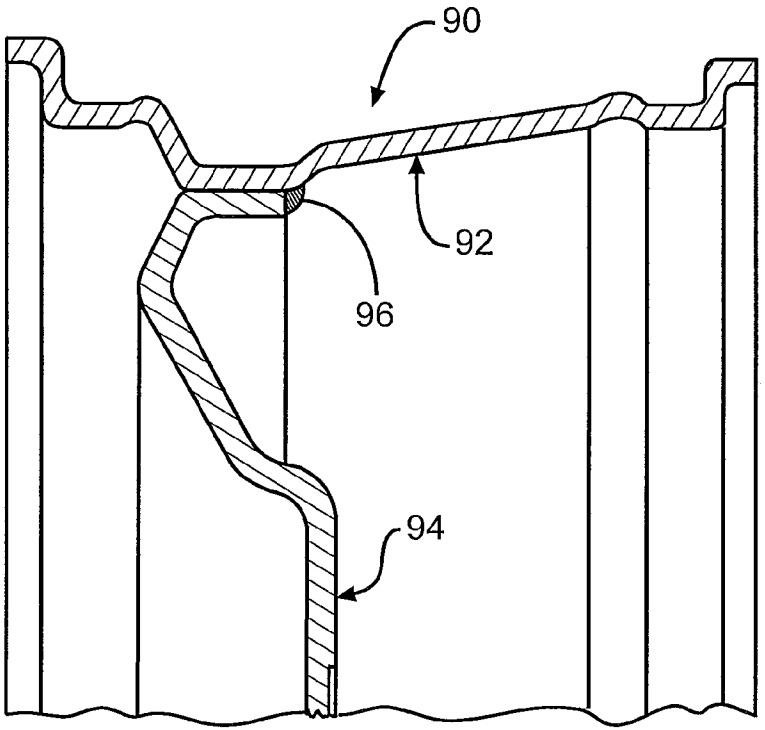
FIG. 6 is a view of a second embodiment of a fabricated vehicle wheel, including the first embodiment of the finished wheel rim of FIG. 4.

As discussed above, the present invention can be used to produce a wheel rim for use in other kinds of fabricated vehicle wheels. For example, referring to FIG. 6, there is illustrated a fabricated well attached vehicle wheel, indicated generally at 90. In this embodiment, the vehicle wheel 90 can include a wheel rim 92, which can be formed in a manner similar to that for wheel rim 64. The wheel rim 92 can then be secured to a preformed wheel disc 94 by one or more welds 96 to produce the well attached vehicle wheel 90.

Figure 8:
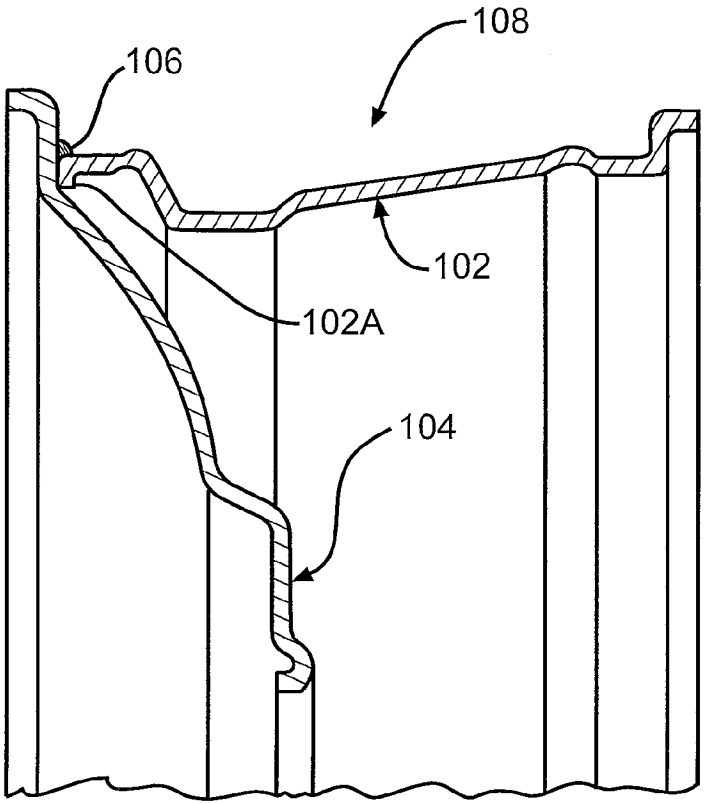
FIG. 8 is a view of a third embodiment of a fabricated vehicle wheel, including the second embodiment of the finished wheel rim of FIG. 7.
Figure 7:
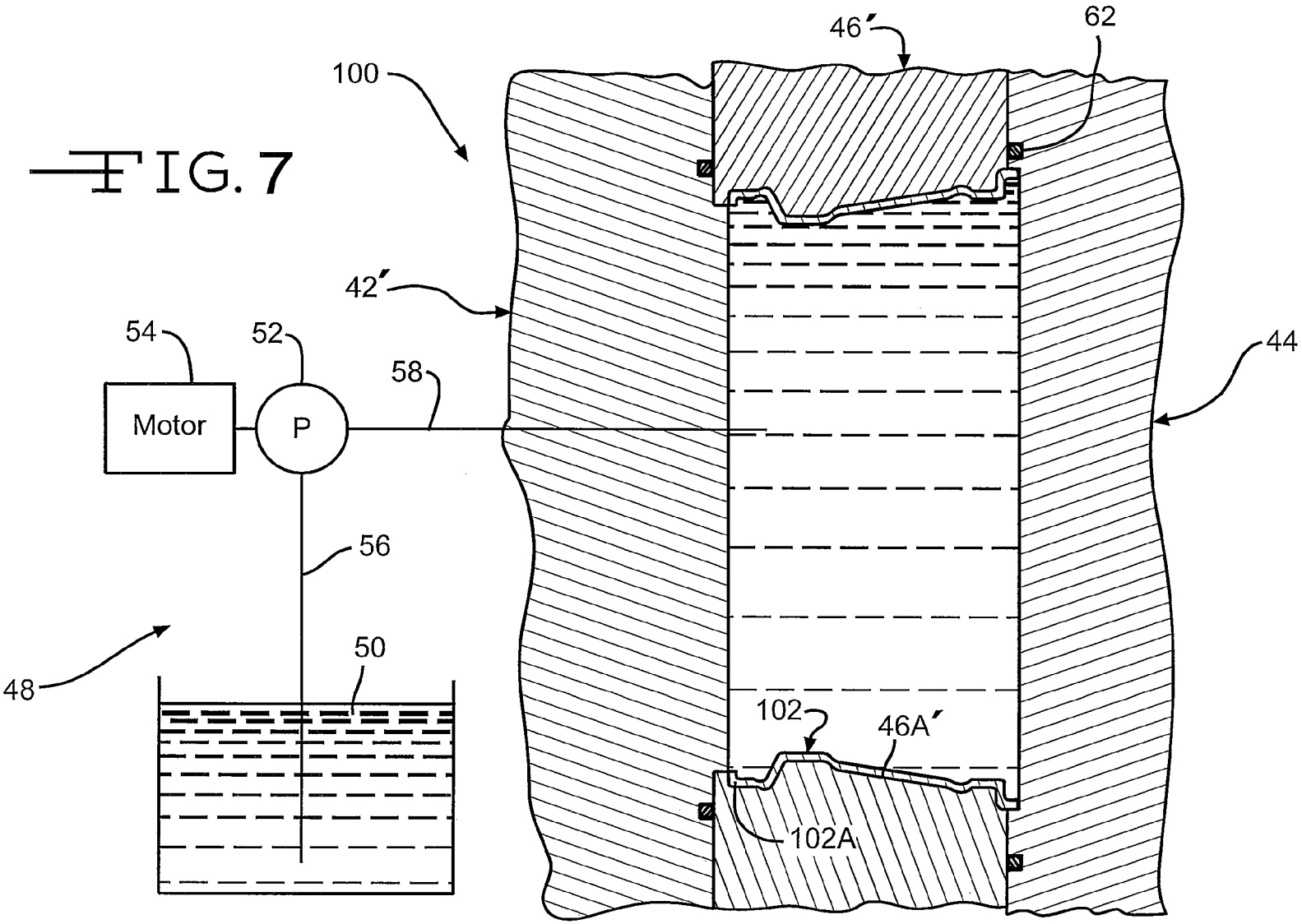
FIG. 7 is a view similar to FIG. 4 showing a portion of a second tooling for use in producing a second embodiment of a finished wheel rim, showing the end working position of the second tooling to produce the second embodiment of the finished wheel rim.

Referring now to FIG. 7 and using like reference numbers to indicate corresponding parts, there is illustrated a tooling fixture or apparatus, indicated generally at 100, which is used to produce a finished wheel rim, indicated generally at 102 therein. The tooling fixture 100 is the same as the tooling fixture 40 shown in FIGS. 3 and 4, except that in this embodiment a third tooling member 46' includes an inner surface, indicated generally at 46A', having a predetermined inner surface contour which is different from the inner surface contour 46A of third tooling member 46 shown in FIGS. 3 and 4. Also, in this embodiment, adjacent surfaces of the third tooling member 46' and a first tooling member 42' are shaped or configured so as to produce an inturned flange 102A during step 14. As a result of this, in this embodiment the finished wheel rim 102 is a partial wheel rim which is adapted to be secured to a full face wheel disc by one or more welds 106, as shown in FIG. 8, to produce a fabricated full face fabricated vehicle wheel 108.

One advantage of the present invention is that the number of steps used to produce the wheel rim 64, 92, 102 for use in producing the respective vehicle wheel, 80, 90, 108, is reduced compared to conventional "mechanical" wheel rim forming processes, which typically include at least three mechanical metal forming operations to produce a finished wheel rim. As discussed above, after the wheel rim is preformed, the final shape of the wheel rim can be produced in a single operation using high pressure hydraulic fluid. Also, the present invention can more accurately form the finished wheel rim 64, 92, 102 to more precise and/or complex shapes all in a single forming operation using the high pressure hydraulic fluid.

In accordance with the provisions of the patent statutes, the principle and mode of operation of this invention have been described and illustrated in its various embodiments. However, it must be understood that the invention may be practiced otherwise than as specifically explained and illustrated without departing from the scope or spirit of the attached claims.

What is claimed is:

1. A method for producing a fabricated vehicle wheel comprising the steps of:

(a) providing a wheel rim blank formed from a suitable material, the wheel rim blank being in the shape of a generally cylindrical hoop;

(b) providing a first tooling fixture for subjecting the wheel rim blank to a preforming operation wherein the cylindrical shape is reshaped to include a plurality of differently shaped portions and produce a wheel rim preform;

(c) providing a second tooling fixture defining a sealed internal chamber and having a split outer tooling member having a predetermined inner surface contour, the sealed internal chamber in fluid communication with a source of high pressure hydraulic fluid;

(d) positioning the wheel rim preform in the sealed internal chamber of the second tooling fixture with an outer surface of the wheel rim preform adjacent the predetermined inner surface contour of the split outer tooling member;

(e) supplying the high pressure hydraulic fluid to the sealed internal chamber of the second tooling fixture whereby the high pressure hydraulic fluid acts upon an inner surface of the wheel rim preform such that the wheel rim preform is pressed against the adjacent predetermined inner surface contour of the split outer tooling member so as to produce a finished wheel rim having a contour which matches that of the predetermined inner surface contour of the split outer tooling member;

(f) removing the finished wheel rim from the second tooling fixture; and (g) securing the finished wheel rim to a wheel disc to produce the fabricated vehicle wheel.

2. The method of claim 1 wherein the second tooling fixture captures opposed ends of the wheel rim preform.

3. The method of claim 2 wherein the second tooling fixture includes at least one shoulder for capturing at least one of the opposed ends of the wheel rim preform.

4. The method of claim 2 wherein the second tooling fixture includes a pair of shoulders for capturing one of each of the opposed ends of the wheel rim preform.

5. The method of claim 2 wherein the second tooling fixture includes an end portion having an inner surface contour adjacent one of the opposed ends of the wheel rim preform and which during step (e) the inner surface contour of the end portion is operative to produce an inturned flange at one of the opposed ends of the wheel rim preform.

6. The method of claim 1 wherein the wheel rim preform of step (b) includes at least a pair of opposed angled end portions.

7. The method of claim 1 wherein the finished wheel rim of step (e) includes at least an inboard tire bead seat retaining flange, an inboard tire bead seat, a well, and an outboard tire bead seat.

8. The method of claim 1 wherein the wheel rim blank of step (a) is formed from the group consisting of steel, aluminum, magnesium, or titanium.

9. A method for producing a fabricated wheel rim adapted for use in a fabricated vehicle wheel comprising the steps of:

(a) providing a wheel rim blank formed from a suitable material, the wheel rim blank being in the shape of a generally cylindrical hoop;

(b) providing a first tooling fixture for subjecting the wheel rim blank to a preforming operation wherein the cylindrical shape is reshaped to include a plurality of differently shaped portions and produce a wheel rim preform;

(c) providing a second tooling fixture defining a sealed internal chamber and having a split outer tooling member having a predetermined inner surface contour, the sealed internal chamber in fluid communication with a source of high pressure hydraulic fluid;

(d) positioning the wheel rim preform in the sealed internal chamber of the second tooling fixture with an outer surface of the wheel rim preform adjacent the predetermined inner surface contour of the split outer tooling member;

(e) supplying the high pressure hydraulic fluid to the sealed internal chamber of the second tooling fixture whereby the high pressure hydraulic fluid acts upon an inner surface of the wheel rim preform such that the wheel rim preform is pressed against the adjacent predetermined inner surface contour of the split outer tooling member so as to produce a finished wheel rim having a contour which matches that of the predetermined inner surface contour of the split outer tooling member; and (f) removing the finished wheel rim from the second tooling fixture for subsequent securing to a wheel disc to produce the fabricated vehicle wheel.

10. The method of claim 9 wherein the second tooling fixture captures opposed ends of the wheel rim preform.

11. The method of claim 10 wherein the second tooling fixture includes at least one shoulder for capturing at least one of the opposed ends of the wheel rim preform.

12. The method of claim 10 wherein the second tooling fixture includes a pair of shoulders for capturing one of each of the opposed ends of the wheel rim preform.

13. The method of claim 10 wherein the second tooling fixture includes an end portion having an inner surface contour adjacent one of the opposed ends of the wheel rim preform and which during step (e) the inner surface contour of the end portion is operative to produce an inturned flange at one of the opposed ends of the wheel rim preform.

14. The method of claim 9 wherein the wheel rim preform of step (b) includes at least a pair of opposed angled end portions.

15. The method of claim 9 wherein the finished wheel rim of step (e) includes at least an inboard tire bead seat retaining flange, an inboard tire bead seat, a well, and an outboard tire bead seat.

16. The method of claim 9 wherein the wheel rim blank of step (a) is formed from the group consisting of steel, aluminum, magnesium, or titanium.

17. A method for producing a fabricated vehicle wheel comprising the steps of:

(a) providing a wheel rim blank formed from a suitable material selected from the group consisting of steel, aluminum, magnesium, or titanium, the wheel rim blank being in the shape of a generally cylindrical hoop;

(b) providing a first tooling fixture for subjecting the wheel rim blank to a preforming operation wherein the cylindrical shape is reshaped to include a plurality of differently shaped portions and produce a wheel rim preform, the wheel rim preform including at least a pair of opposed angled end portions;

(c) providing a second tooling fixture defining a sealed internal chamber and having a split outer tooling member having a predetermined inner surface contour, the sealed internal chamber in fluid communication with a source of high pressure hydraulic fluid;

(d) positioning the wheel rim preform in the sealed internal chamber of the second tooling fixture with an outer surface of the wheel rim preform adjacent the predetermined inner surface contour of the split outer tooling member and with the second tooling fixture capturing the opposed angled end portions of the wheel rim preform;

(e) supplying the high pressure hydraulic fluid to the sealed internal chamber of the second tooling fixture whereby the high pressure hydraulic fluid acts upon an inner surface of the wheel rim preform such that the wheel rim preform is pressed against the adjacent predetermined inner surface contour of the split outer tooling member so as to produce a wheel rim having a contour which matches that of the predetermined inner surface contour of the split outer tooling member;

(f) removing the wheel rim from the second tooling fixture; and (g) securing the wheel rim to a wheel disc to produce the fabricated vehicle wheel.

* * * * *